US006926550B2

(12) United States Patent
Ursich

(10) Patent No.: US 6,926,550 B2
(45) Date of Patent: Aug. 9, 2005

(54) SELF-LOCKING ELECTRICAL RECEPTACLE HAVING SAFETY PROTECTOR

(75) Inventor: Nels E. Ursich, Tinley Park, IL (US)

(73) Assignee: Ursich Electric Products, Inc., Tinley Park, IL (US)

( * ) Notice: Subject to any disclaimer, the term of this patent is extended or adjusted under 35 U.S.C. 154(b) by 0 days.

(21) Appl. No.: 10/612,616

(22) Filed: Jul. 2, 2003

(65) Prior Publication Data

US 2004/0127086 A1 Jul. 1, 2004

Related U.S. Application Data

(63) Continuation of application No. 09/843,570, filed on Apr. 26, 2001, now abandoned.

(60) Provisional application No. 60/199,926, filed on Apr. 26, 2000.

(51) Int. Cl.[7] ..... H01R 13/625

(52) U.S. Cl. ..... 439/346

(58) Field of Search ..... 439/346, 180, 439/188, 345, 348, 347, 134, 140, 369, 373

(56) References Cited

U.S. PATENT DOCUMENTS

| | | | | | |
|---|---|---|---|---|---|
| 4,179,175 | A | * | 12/1979 | Farnworth et al. | 439/140 |
| 5,320,545 | A | * | 6/1994 | Brothers | 439/188 |
| 5,413,498 | A | * | 5/1995 | Ursich | 439/346 |
| 5,921,798 | A | * | 7/1999 | Ursich | 439/346 |
| 6,049,143 | A | * | 4/2000 | Simpson et al. | 307/126 |

* cited by examiner

*Primary Examiner*—Alexander Gilman
(74) *Attorney, Agent, or Firm*—Edward D. Gilhooly

(57) ABSTRACT

A locking electrical receptacle for receiving the spaced prongs of a male plug. The electrical receptacle has electrical contacts which engage a prong only when the prong is fully inserted in the receptacle. A locking ball is mounted for relative movement in an open slot of an moveable actuator. The open slot has a shallow section which biases the locking ball into the punched hole of the male prong.

19 Claims, 7 Drawing Sheets

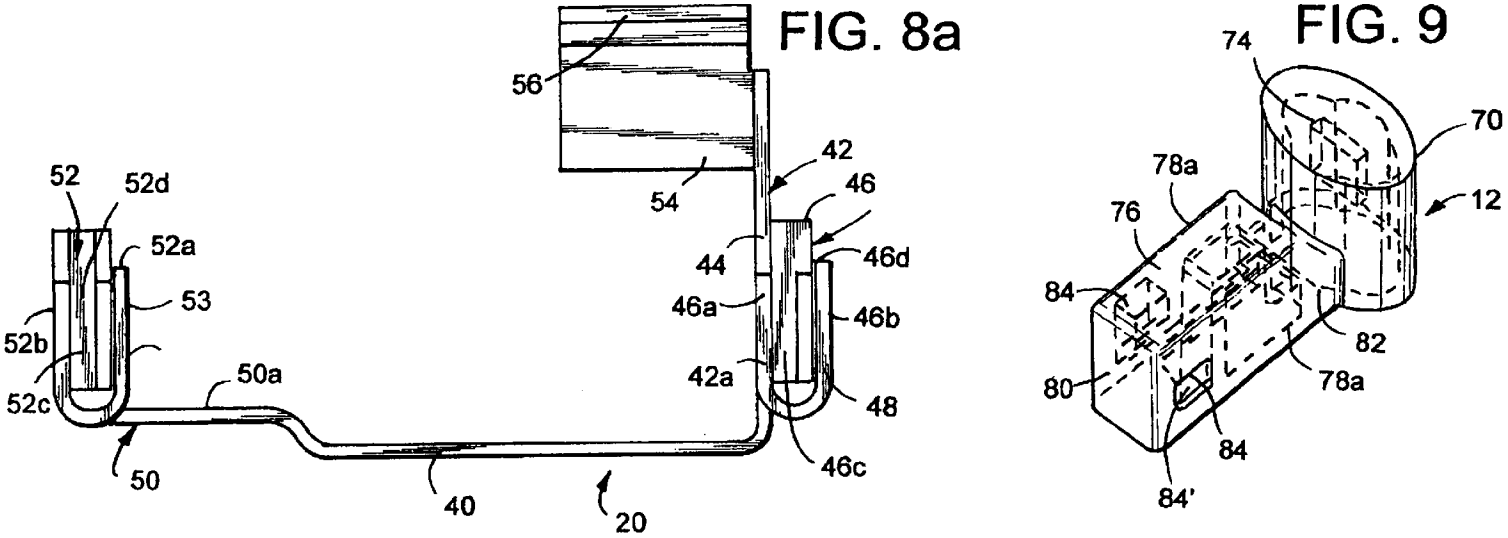
FIG. 8a
FIG. 9
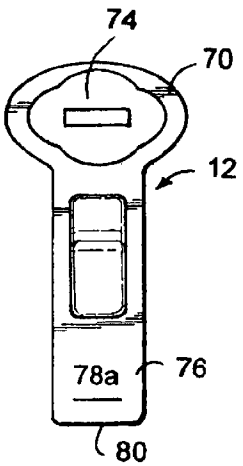
FIG. 12
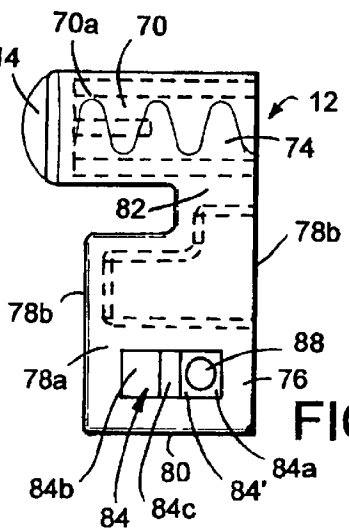
FIG. 11
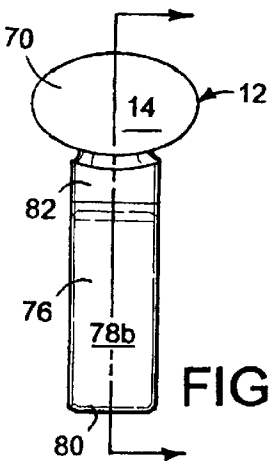
FIG. 10

SELF-LOCKING ELECTRICAL RECEPTACLE HAVING SAFETY PROTECTOR

This application is a continuation of Non-provisional application Ser. No. 09/843,570 filed Apr. 26, 2001 now abandoned and claims benefit of the filing date of Provisional Application, Ser. No. 60/199,926 filed Apr. 26, 2000.

BACKGROUND OF THE INVENTION

1. Field of the Invention

This invention relates in general to electrical receptacles for receiving male plugs and, more particularly, to a self-locking electrical receptacle having a safety protector preventing a hazardous condition resulting from the partial insertion of a male prong of a plug into the receptacle.

2. Summary of the Prior Art

Electrical receptacles are in universal use to provide current to an electrical cord through the connection with a male plug having male metal prongs. The prongs of the plug are normally secured in position by frictional contact with internal members of the electrical receptacle. A typical electrical receptacle is capable of conducting electricity to the prongs of the male plug even when the prongs are partially inserted into the receptacle. The exposure of male plugs externally of the receptacle when coupled to an electrical current can present significant safety hazards to any individual who comes into any direct or indirect contact with the exposed energized metal elements of the prongs.

It is also well known that a plug within a conventional electrical receptacle can easily be withdrawn intentionally or by accident to create a disconnection of the circuit to which the receptacle is coupled. There are many circumstances under which it is desirable for reasons of convenience or safety that the connection between a plug and an electrical cord and an electrical receptacle be maintained even when significant forces are applied to disconnect the union of plug and receptacle. Several techniques have been employed in the past in an attempt to provide a more secure electrical connection between the receptacle and the plug. Most of these designs have not attained satisfactory results in use. A common problem arising from many of the prior self-locking designs is their failure to provide easy insertion and release of the lock connection. One improved design of locking the prongs of a male plug to an electrical receptacle is disclosed in U.S. Pat. No. 5,413,498 to Ursich and entitled Self-Locking Female Receptor for Electrical Cords. Although the receptor of the Ursich plug provides a highly efficient locking and release technique of the plug, it is desirable to provide improved features directed to the protection against an exposed prong and provide a lock mechanism capable of optimum locking and release within the environment of an electrical receptacle.

SUMMARY OF THE INVENTION

It is, therefore, an objective of the invention to provide an improved self-locking electrical receptacle having a safety protector. The electrical receptacle herein disclosed may serve as a wall outlet and the like for receiving the plugs of electrical cords of countless types of products and appliances. The receptacle includes an externally operated actuator member for each electrical plug outlet which is moveable relative to the prongs of an inserted male plug to bias locking elements into the holes of a pair of prongs to secure the plug against withdrawal when the cord is subjected to even a substantial force. The actuator member herein disclosed is operatively connected to locking elements which are positioned within guide means that has the capability of inserting, maintaining, or releasing locking elements relative to the conventional punched holes of the prongs of the male plug during movement of the actuator member. The actuator member may be manipulated externally of the receptacle to cause its movement within the electrical receptacle for insertion or release of the male plug. The external actuator of the actuator member is formed with an unique cross-sectional configuration to improve ease of use and to allow better insertion of male plugs having large structural configurations or other interference type problems.

The safety protection means of the invention insures that exposed prongs of a partially inserted plug in the receptacle of the invention are not connected to an electrical current. Such protection is attained in accordance with the invention because of uniquely designed terminals of the electrical receptacle herein disclosed. The terminals are provided with electrical contact means that engage the inserted plug only when the plug is fully inserted into the electrical receptacle of the invention. Thus, if the plug is only partially inserted to expose the prongs of the plug and create a potential electrical hazard, no electrical connection is provided between the terminals of the receptacle and the prongs. Thus, any hazard resulting from exposure of partially inserted prongs is substantially eliminated by the design of the invention.

BRIEF DESCRIPTION OF THE DRAWINGS

FIG. 8*a* is a front elevational view of the terminal of FIG. 8;

FIG. 9 is a lower perspective view of the locking actuator member of the self-locking receptacle of FIG. 1;

FIG. 10 is a front elevational view of the locking actuator member of FIG. 9;

FIG. 11 is a side elevational view taken along lines 11—11 of FIG. 10; and FIG. 12 is a back elevational view of the locking actuator member of the electrical receptacle of FIG. 9.

DESCRIPTION OF THE PREFERRED EMBODIMENT

Figure 2:
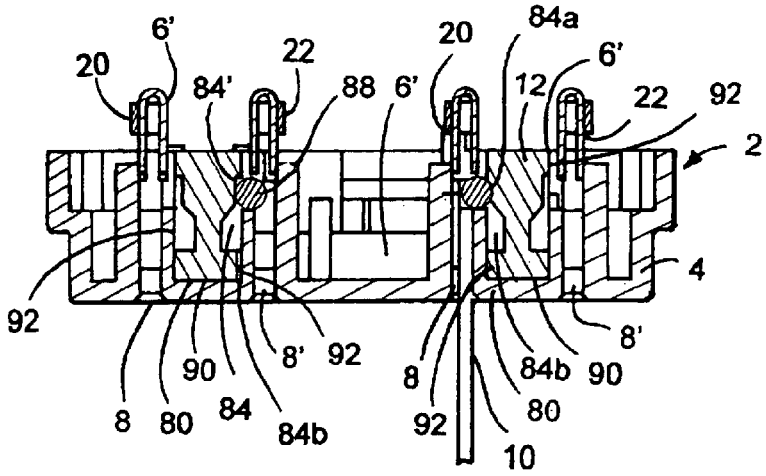
FIG. 2 is a top plan view, with parts in section, taken along lines 2—2 of FIG. 1.
Figure 1:
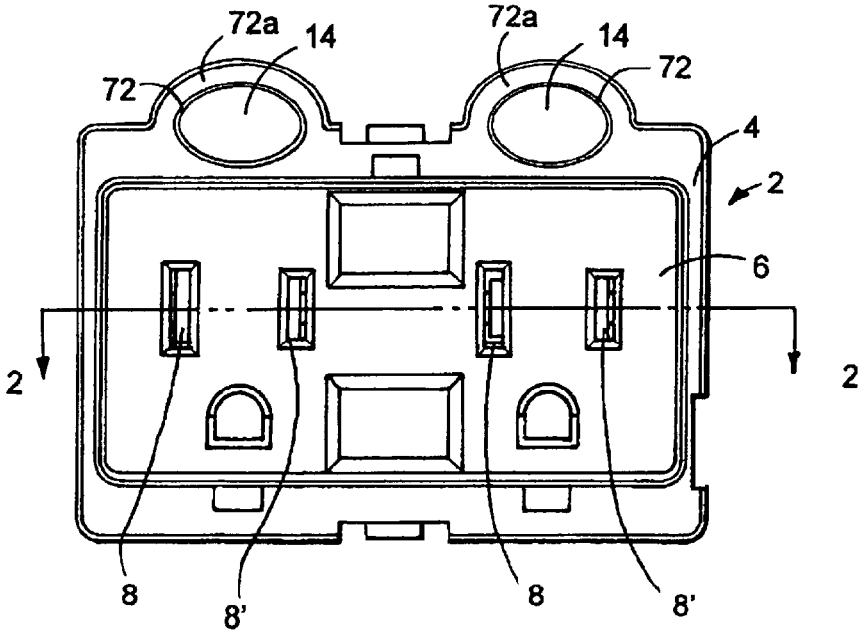
FIG. 1 is a front elevational view of the self-locking electrical receptacle having the safety protector of the invention.
Figure 3:
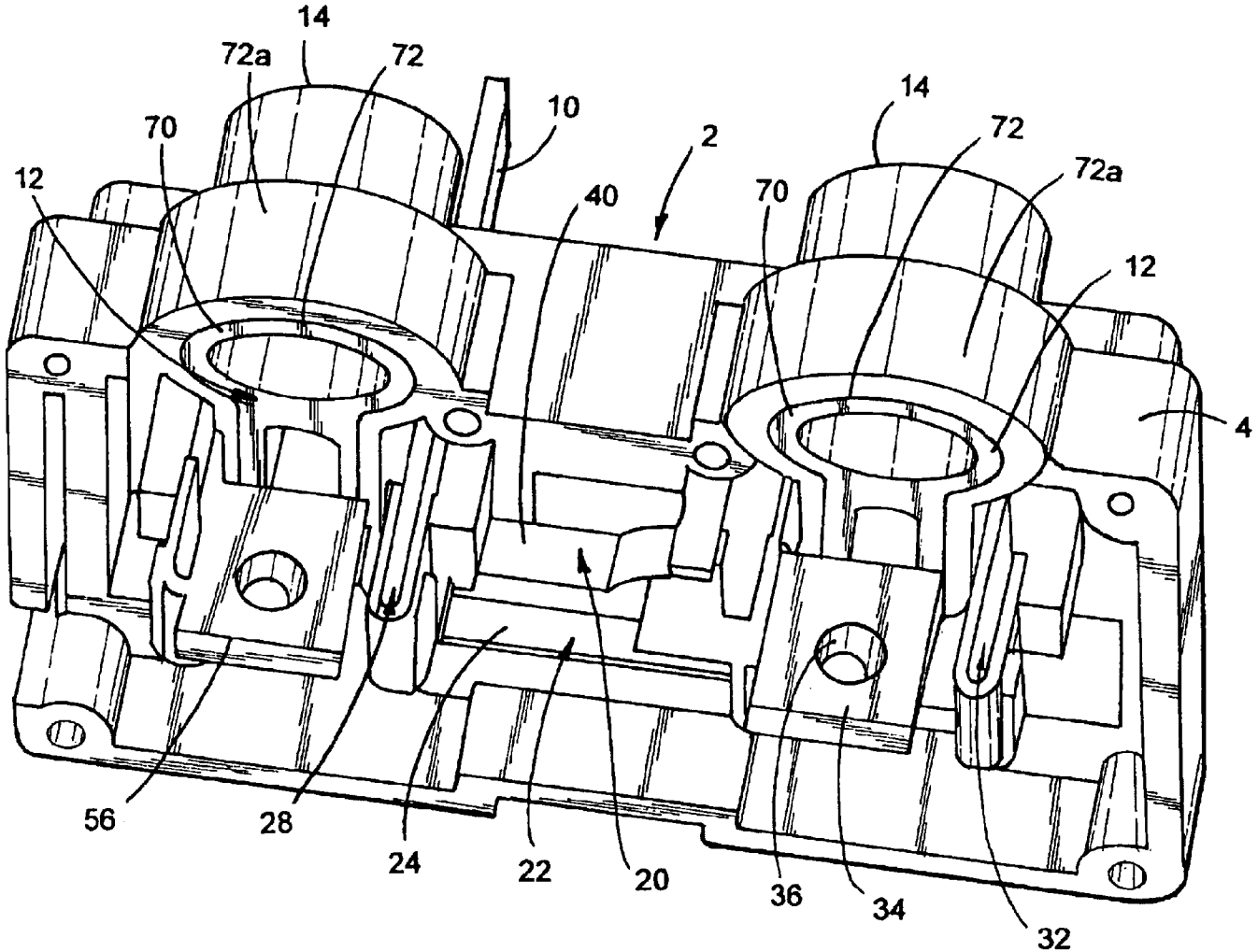
FIG. 3 is a back top perspective view, with parts broken away, of the self-locking receptacle of FIG. 1.

Referring now to FIGS. 1–3 and 4*a*, there is illustrated the self-locking electrical receptacle of the invention, generally designated by reference numeral 2. The electrical receptacle 2 includes a molded non-conductive plastic housing 4 having a cover plate 6 and hollow cavities 6' for receiving the internal components of the electrical receptacle 2. The cover plate 6 is provided with two pairs of holes 8 and 8' at each outlet to respectively receive the conventional spaced male prongs 10 of a plug (one prong is shown in FIGS. 2 and 3) to create an electrical connection. Although two pairs of holes are shown in the embodiment of FIG. 1, it is within the scope of the invention to provide a single outlet formed by a pair of holes or more than two outlets in the receptacle 2 respectively formed by a pair of holes as is desired. As further seen in FIG. 2, electrical receptacle 2 includes a pair of internal actuator members 12 for locking and releasing an inserted plug (not shown). The actuator member 12 includes oval shaped, depressible actuator elements 14 that are accessible externally extending through a pair of holes 16 in cover plate 6. The actuator elements 14 are pressed to allow insertion of a male plug and pressed to release a locked plug as will be described. The oval shape of actuator element 14 not only increases the convenience and ease of depression of the actuator member 12, but also includes a greater width parallel to holes 8 and 8' than height to permit insertion of a plug having unusually large dimensions or to accommodate any unusual structural obstructions adjacent the receptacle 2.

Figure 4:
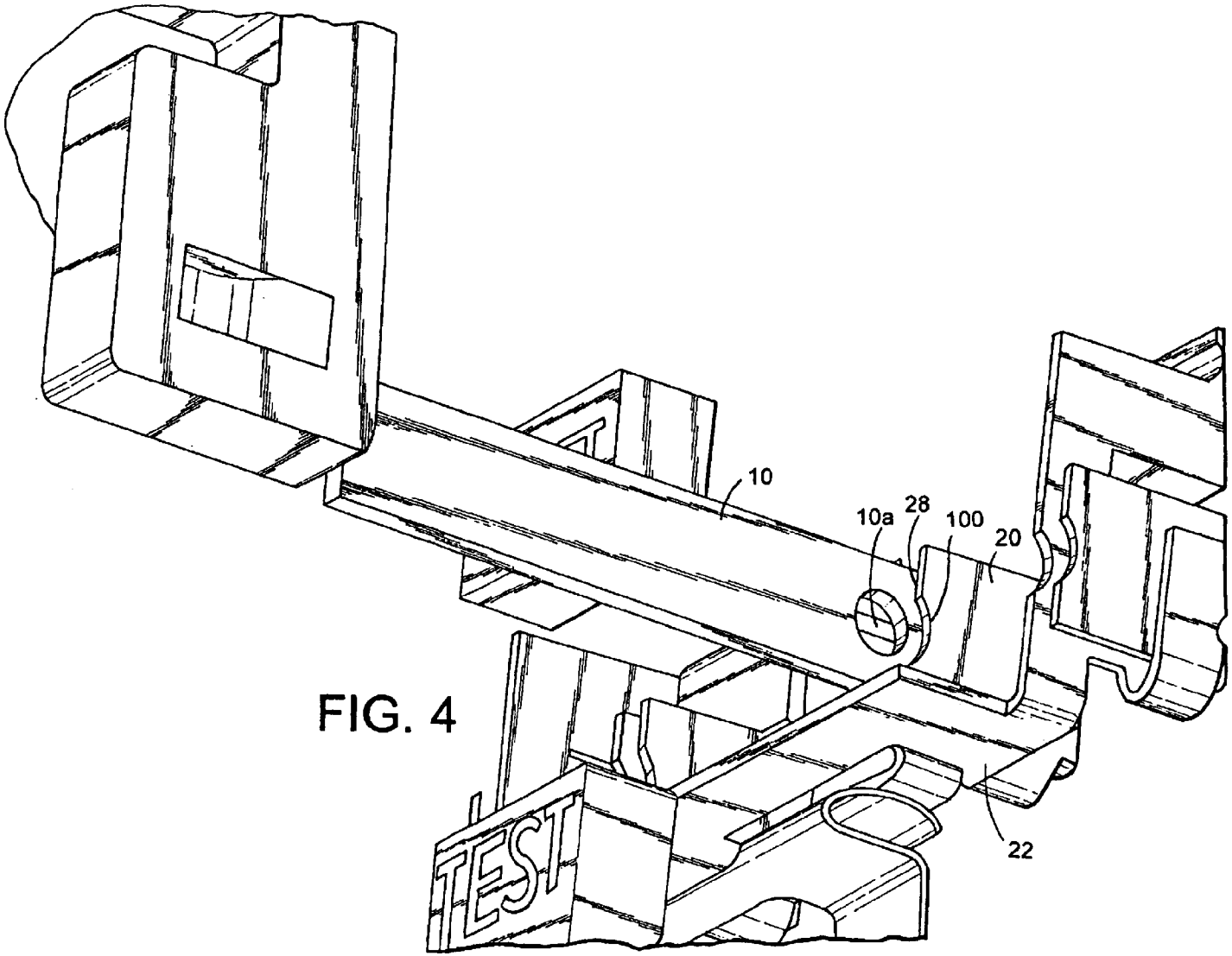
FIG. 4 is a side perspective view, with parts broken away, of a male plug being inserted into electrical contact with a terminal of a self-locking electrical receptacle of FIG. 1.
Figure 4A:
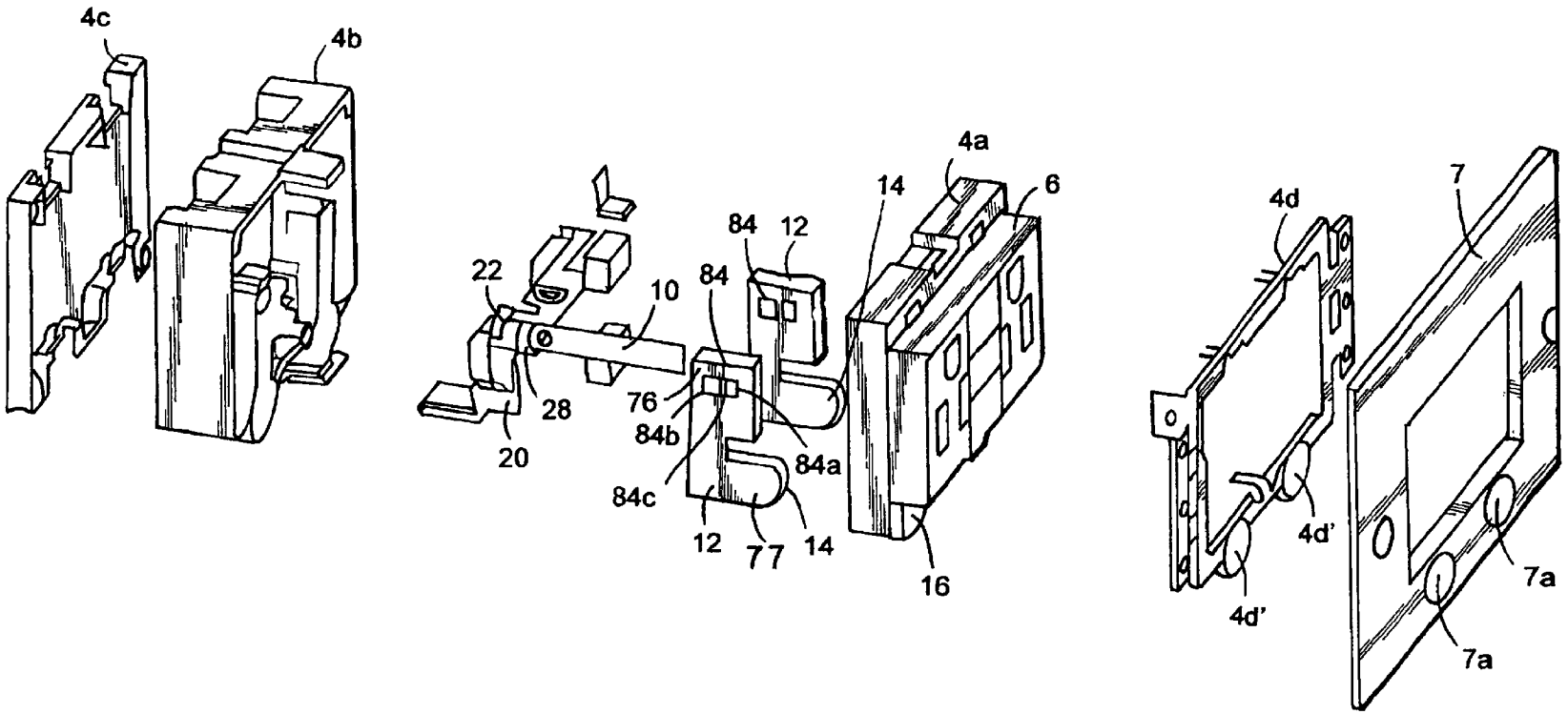
FIG. 4*a* is a bottom perspective view, with parts exploded, of the electrical receptacle of FIG. 1.
Figure 5:
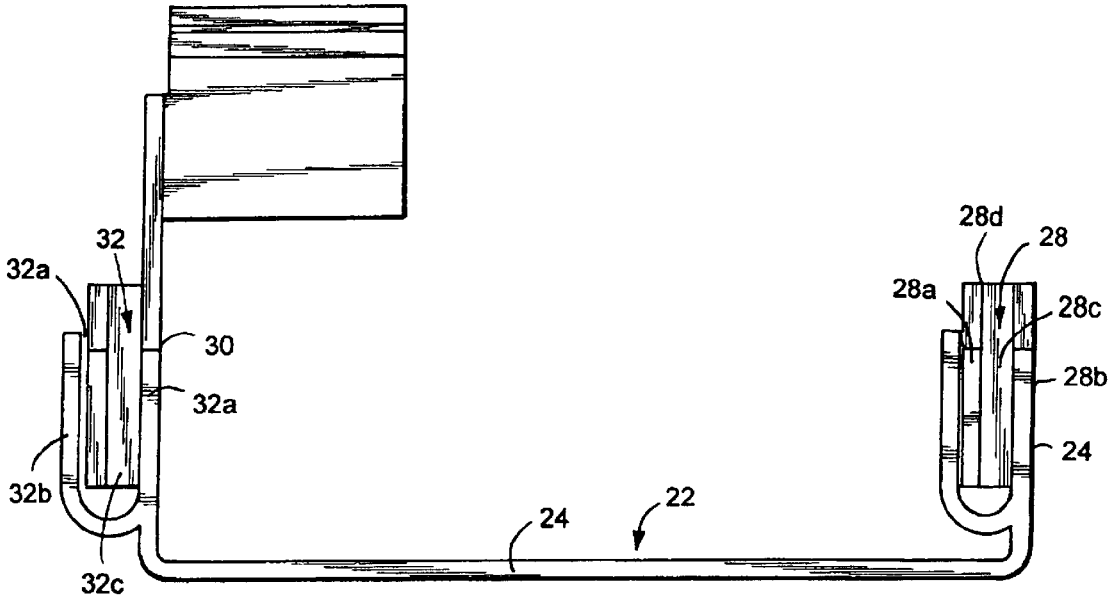
FIG. 5 is a front elevational view of one of the electrical terminals of the electrical receptacle of FIG. 1.
Figure 6:
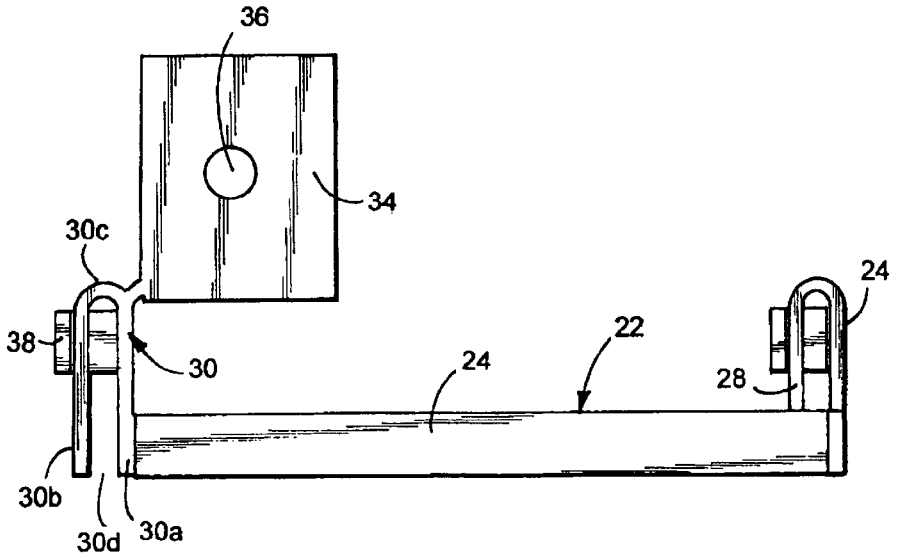
FIG. 6 is a top plan view of the electrical terminal of FIG. 5.
Figure 7:
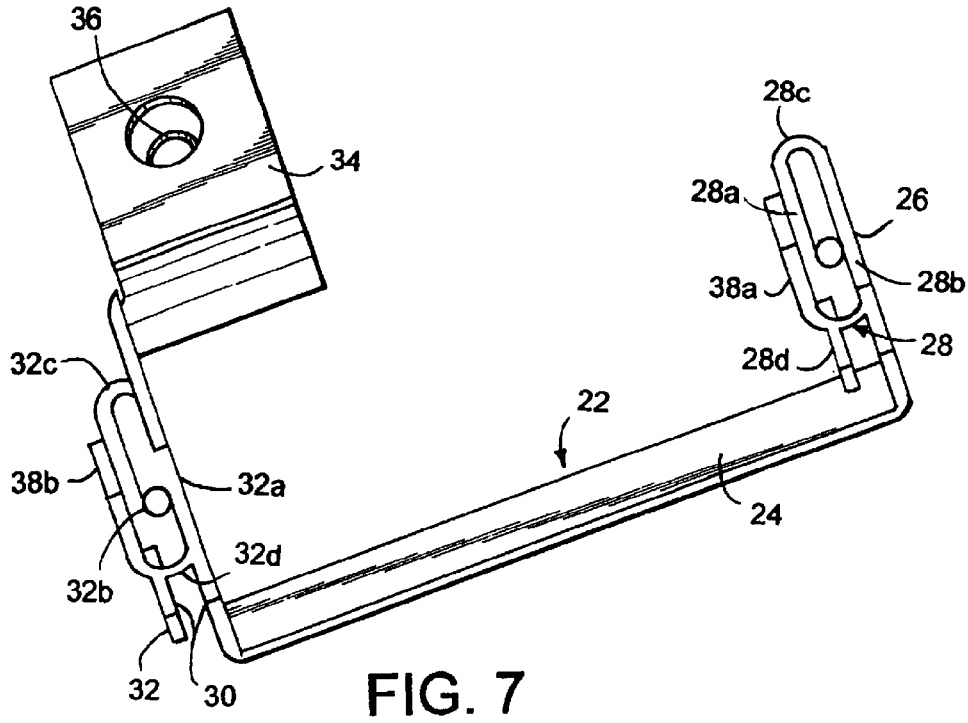
FIG. 7 is a lower rear perspective view of the electrical terminal of FIG. 5.

In FIG. 4*a*, the components of housing 4 are best shown. The receptacle housing 4 includes face plate 6, front wall 4*a*, body 4*b*, and rear plate 4*c* which are interconnected as an unit by mechanical connectors (not shown). A cover plate 7 is affixed to face plate 6, between which a rectangular shaped ground 4*d* is sandwiched. The cover plate 7 having central cutout 7' and ground plate 4*d* respectively includes a pair of holes 7*a* and 4*d'* through which actuator element 14 of the actuator member 12 extends for external access. Mechanical fasteners (not shown) may extend through holes 7*b* and 4*d"* to secure the components to the receptacle body.

As seen in FIG. 3, the electrical receptacle 2 includes a pair of separate stamped terminals 20 and 22. The terminal 20 is connected to a source of electrical potential and creates an electrical connection with one prong 10 of the male plug being inserted into hole 8. The terminal 22 is neutral and is arranged to contact the other prong of a plug being inserted within hole 8' of each outlet.

Referring to FIGS. 3, and 5 to 7, details of neutral terminal 22 are best shown. The terminal 22 is formed as a one-piece stamping from a conductive material, such as copper or brass, and is formed with a flat base 24. One end portion 26 of the terminal 22 is disposed at a ninety degree angle to base 24 form a U-shaped prong contact slot 28 which is positioned to receive one end portion of a prong 10 of a plug when fully inserted through hole 8' to create a circuit in a manner to be described. The opposite end portion 30 of terminal 22 is also bent up in the same direction as end portion 26 and is formed into a second U-shaped contact slot 32 to receive the prong 10 of another plug being inserted in electrical receptacle 2 into hole 8'. Contact slot 28 includes a pair of spaced flat contact elements 28*a*, 28*b* and 28*c* to form a rectangular prong receiving opening 28*d*. Further as seen in FIGS. 1 to 4 and 8 contact slot 32 includes a pair of spaced flat contact elements 32*a* and 32*b* and connecting portion 32*c* to form prong receiving opening 32*d*.

The lengths of the contact elements 28*a*, 28*b* and 32*a*, 32*b* and the distances of prong receiving openings 28*d*, 32*d* from the external portion of holes 8' are selected to receive and make contact with a prong 10 when only the prong is fully inserted in holes 8' and further permit the punched hole 10*a* of a prong 10 be exposed for locking (FIG. 4). Thus, the only inserted position at which prong 10 can be in electrical contact with slots 28 and 32 of terminal 22 is by being substantially fully inserted into holes 8'. An electrical connection is prevented between the prongs and the respective contact element when a prong 10 is partially inserted and externally exposing the prong. The end portion 30 (FIG. 7) extends upward and bent over to form a two layer flat lead connector 34 having a hole 36 to allow a threaded member (not shown) to be inserted and attach an electrical lead (not shown) to the terminal 22 which is to ground. Strengthening sections 38*a* and 38*b* of end portions 26 and 30 are respectively bent over slots 28 and 32 to increase the structural strength of the contact slots. The spacing between contact elements 28*a* and 28*b* and between contact elements 32*a* and 32*b* is selected to insure contact with the inserted plug and make an electrical connection therebetween.

Figure 8:
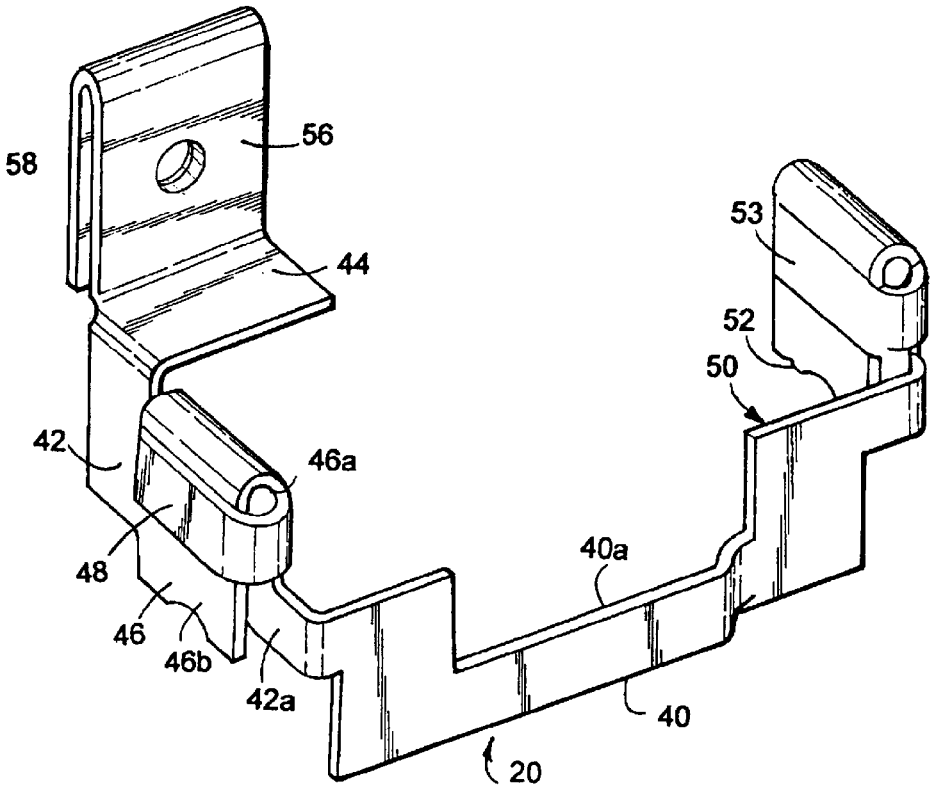
FIG. 8 is a lower perspective plan view of the second electrical terminal of the electrical receptacle of FIG. 1.

Referring to FIGS. 8 and 8*a*, details of the energized electrical conductive terminal 20 is best illustrated. As seen in FIG. 3, the terminal 20 includes a modified shape as compared to terminal 22 to allow it to be disposed within the housing 4 in spaced adjacent relationship to terminal 22 within housing 4. The terminal 20 has a base 40 having a cutout section 40*a*. A bent end portion 42 of terminal 20 includes two right-angled sections 42*a*, 44. End portion 44 is bent back to form a U-shaped contact slot 46 for contact with a male prong 10. The contact slot 46 includes spaced contact elements 46*a* and 46*b* and connecting portion 46*c* to form prong receiving opening 46*d*. A strengthening element 48 is bent back into contact with contact slot 46 for increasing the strength of the contact.

The other end portion 50 of terminal 20 includes a section 50*a* offset in parallel relation to base 40 and a right angled section 50*b* having a U-shaped projection extending therefrom to form a second contact slot 52 to receive another prong 14 of the plug being inserted into the electrical receptacle 2. The contact slot 52 includes spaced contact elements 52*a* and 52*b* and connecting portion 52*c* to form prong receiving opening 52*d*. A bent over section 53 increases the strength of contact 52. The right angled section 42 has an upward extension 54 that is bent at a right angle to form a bent back connector 56 having a hole 58 to allow a wire connected to an electrical current to be attached by a threaded element (not shown) and the like. As seen in FIG. 3, the contact slot 46 of terminal 20 is disposed in opposed operative relationship to the contact slot 28 of terminal 22 to receive a pair of prongs 10 of a plug being inserted into holes 8, 8' of the receptacle 2. The contact slot 52 is disposed adjacent to contact slot 30 of terminal 22 to receive the prongs 10 of another inserted plug to connect the circuit to a source of electrical current and to neutral. Inasmuch as contact slots 46 and 52 of terminal 20 are of a substantially identical construction as contact slots 28 and 30 of terminal 22 and are positioned at an identical depth within housing 4, each prong 10 creates electrical contact with a contact slot when its end portion is inserted with each punched hole 10*a* is exposed as seen in FIG. 4. To aid in exposure of the punched hole, a curved cutout 100 (FIG. 4) may be provided on the end of each open ended contact slot of terminals 20 and 22. Accordingly, a prong 10 must be fully inserted into the electrical receptacle into slots 28, 46 or slots 30, 52 before contact with the terminals 20 and 22 is made for an electrical connection. Thus, prior to full insertion, any exposed portions of the prongs 10 are not connected to the terminals 20 and 22 and do not create a potential hazard because the prongs are not fully inserted.

Referring now to FIGS. 1, 2, 3, 4*a* and 9 to 12, details of actuator member 12 for locking and releasing an inserted plug 10 are best illustrated. Actuator member 12 may be formed as a single-piece, non-conductive plastic material and the like. The upper portion 70 of actuator member 12 projects through an opening 72 formed in the upper portion 72*a* of electrical receptacle 2 and the cover plate holes 16, and forms external actuator 14, which may be manually depressed. The cross-sectional configuration of upper portion 70 is generally oval as previously described. An open cavity 74 is formed in the rear of upper portion 70 and receives a resilient spring 74*a* disposed between wall 74' and element 74" of the cavity 74 and a portion (not shown) of housing 4 to bias the actuator member 12 outward relative to electrical receptacle 2 when the actuator 14 is released.

The base 76 of actuator member 12 is formed as a block having generally flat side opposed faces 78*a*, 78*b* and flat bottom face 80. The base 76 is interconnected to upper portion 70 by a narrowed intermediate section 82. The opposed faces 78*a* each have a locking slot 84 creating a guide means for a locking element 88 in the form of a plastic ball and the like (FIGS. 2 and 11). The slot 84 has a varying depth with slot section 84*a* having a shallower depth than lower slot section 84*b* (FIG. 11). The slot sections 84*a* and 84*b* are interconnected by a connecting ramp 84*c*. The locking element 88 in the form of a plastic ball and the like is situated within the opposed locking slots 84 of both actuator members 12 of a size to engage prong hole 10*a*. As seen in FIG. 2, bottom face 80 is slideable along wall 90 of housing 4 while face 78*c* contacts for a sliding motion walls 92 of housing 4. The bottom face 80*c* of actuator member 12 also is slideable along a surface (not shown) of housing 4. Accordingly, it should be apparent that depression of actuator element 14' causes the actuator member 12 to move along an axis generally perpendicular to the place of faceplate 6.

As seen in FIGS. 2, 9 and 11, each of the opposed slots 84 having a longitudinal axis extending parallel along the axis of movement of the actuator member 12. As a result, the locking element 88 is positioned in shallow slot section 84*a* while the actuator member 12 is in its normal, outwardly biased position. As the actuator 14 is depressed to cause movement of the actuator member 12 within the receptacle 2, the locking element 88 is positioned within the deeper slot section 84*b*. While in the deeper slot section 84*b*, the locking element moves away from the prong 10 or prong hole 10*a* to allow the insertion of the prong of a plug or release of a locking element 88 positioned in prong hole 10*a* during depression of the actuator member 14. Upon release of the actuator member 12 after a prong 10 is fully inserted, the locking element 88 is positioned in the shallow section 84*a* by which the wall 84' of slot 84 (FIGS. 2, 9 and 11) biases the locking element 88 into the exposed, adjacent hole 10*a* of an inserted prong. A pair of actuator members 12 are employed in connection with the pair of holes 8 and 8' of each outlet of the two outlet electrical receptacle 2. Thus, additional actuator members 12 and locking elements 88 may be used when the electrical receptacle 2 includes more than two electrical outlets as shown. As seen in FIG. 2, each actuator member is moveable between the spaced prongs 10 of a male plug to respectively insert locking elements 88 into holes 10*a* of the prongs 10 being inserted into contact slots 28 and 46 or slots 30 and 52 of the terminals 20 and 22. The design of the electrical receptacle 2 insures that the prong 10 of a two prong plug is in both a position for locking and in a respective contact slot when substantially fully inserted into electrical receptacle 2.

What is claimed is:

1. An electrical receptacle for receiving conductive male prongs of a male plug comprising a housing having a plurality of prong receiving openings, terminal means mounted within said housing, said terminal means including a plurality of electrical contact elements for creating an electrical connection with a respective prong inserted into said plurality of openings, said plurality of electrical contacts being positioned at a location within said housing to contact the male plugs and establish an electrical connection with a male plug only when a respective prong is substantially fully inserted into said housing and to prevent an electrical connection to be established by not contacting the plurality of electrical contacts when a respective prong is only partially inserted into said housing, said plurality of openings include at least one pair of spaced openings for receiving the spaced prongs of a respective male plug, said plurality of electrical contacts each include a pair of spaced conductive elements for contacting a respective prong, and said spaced conductive elements being a pair of generally U-shaped contact slots for receiving a respective prong of a male plug when fully inserted in said openings to create the electrical connection, said pair of U-shaped contact slots being integrally formed on a terminal member, and said terminal means being a one piece stamping having said plurality of electrical contacts.

2. The electrical receptacle according to claim 1 wherein said terminal includes a base connecting said pair of U-shaped contacts being bent at generally ninety degree angles to said base to receive a respective prong.

3. The electrical receptacle according to claim 1 wherein said terminal means being a one piece stamping having said plurality of electrical contacts and said terminal.

4. The electrical receptacle according to claim 1 further comprising locking means for releasably locking a prong of the male plug inserted into electrical contact with a respective one of said plurality of electrical contacts.

5. The electrical receptacle according to claim 4 wherein said locking means includes an actuator for locking and releasing the male prong.

6. The electrical receptacle according to claim 5 wherein the actuator includes an external portion extending through said housing, said external portion providing external access to lock and release the male prong.

7. The electrical receptacle according to claim 6 wherein said locking means includes an open slot formed on said actuator for receiving said locking element, said open slot having a variable depth for locking and releasing said locking element from engagement with a male prong.

8. The electrical receptacle according to claim 7 wherein said actuator is moveable along an axis relative to said housing lying generally parallel to the insert prong.

9. The electrical receptacle according to claim 1 wherein said slot includes a longitudinal axis extending parallel to said axis.

10. An electrical receptacle for receiving conductive male prongs of an external male plug comprising a housing having a plurality of prong receiving openings, terminal means mounted within said housing, said terminal means including a plurality of electrical contact elements for creating an electrical connection with a respective prong inserted into said plurality of openings, said plurality of electrical contacts being positioned within said housing to establish electrical with a male plug when a respective prong is substantially fully inserted into said housing and to prevent an electrical connection to be established when a respective prong is only partially inserted into said housing, said plurality of openings include at least one pair of spaced openings for receiving the spaced prongs of a respective male plug, said plurality of electrical contacts each include a pair of spaced conductive elements for contacting a respective prong, said spaced conductive elements being a pair of generally U-shaped contact slots for receiving a respective prong of a male plug when fully inserted in said openings, said pair of U-shaped contact slot being integrally formed on a terminal member, locking means for releasably locking a prong of the male plug inserted into said electrical contact with a respective one of said plurality of electrical contacts, said locking means includes a locking element for engaging the prong of the male plug inserted for said electrical connection, said pair of generally U-shaped contact slots having a free edge with a cut-out portion provide clearance between said contact slots and the prong holes.

11. An electrical locking receptacle comprising a housing having openings for receiving the inserted prongs with holes of at least one electrical male plug, locking means operatively mounted in said housing for alternatively locking and releasing a male plug received in said housing, a manually operated actuator member mounted for movement in opposite first and second directions for locking an releasing the male plug, said actuator member having an externally accessible actuator element for causing said movement along a first axis, said actuator member further having a block connected to said actuator element and being disposed laterally of said first axis, said locking means including a locking element, said block of said actuator member having having at least one flat face formed with an open slot disposed adjacent an inserted prong, said slot receiving said locking element for relative moveable contact therein parallel to said first axis, said slot having first and second sections, said first section having a shallower depth relative to said face than said second section, said locking element being positionable in said first section upon movement of said actuator member in said first direction for urging the locking element into the punched hole of one of the prongs of the male plug, said locking element being postitionable in said second section upon movement of said actuator member in said second direction.

12. The electrical receptacle according to claim 11 wherein said locking element is a ball.

13. The electrical receptacle according to claim 11 wherein said actuator element is resiliently biased in one direction.

14. The electrical receptacle according to claim 11 wherein said first and second sections are interconnected by ramp means.

15. The electrical locking receptacle according to claim 11 wherein said actuator member includes a pair of opposite flat faces, each of said opposite flat faces having said open slots therein, each of said open slots receiving a locking element, said locking elements being urged into the holes of the prongs for locking.

16. The electrical locking receptacle according to claim 15 wherein said actuator is moveable between the two prongs of a male plug.

17. An electrical locking receptacle comprising a housing having openings for receiving the inserted prongs with holes of at least one electrical male plug, locking means operatively mounted in said housing for alternatively locking and releasing a male plug received in said housing, a manually operated actuator member mounted for movement in opposite first and second directions for locking an releasing the male plug, said actuator member having an externally accessible actuator element for causing said movement, said locking means including a locking element, said actuator member having a face formed with an open slot disposed adjacent an inserted prong for receiving said locking element, said slot having first and second sections, said first section having a shallower depth relative to said face than said second section, said locking element being positionable in said first section upon movement of said actuator member in said first direction for urging the locking element into the punched hole of one of the prongs of the male plug, said locking element being postitionable in said second section upon movement of said actuator member in said second direction, said actuator element having means to provide clearance between an inserted male plug and said actuator element for external accessibility, whereby said means to provide clearance is provided by said accessible actuator element being oval in cross section.

18. The electrical locking receptacle according to claim 17 wherein said housing has openings for receiving the respective prongs of a pair of electrical male plugs, said housing including a pair of said actuator members mounted for movement adjacent the prongs of a respective male plug.

19. An electrical receptacle for receiving conductive male prongs of an external plug comprising a housing having a plurality of prong receiving openings, terminal means mounted within said housing, said terminal means including a plurality of electrical contact elements for creating an electrical connection with a respective prong inserted into said plurality of openings, said plurality of electrical contacts being positioned within said housing to establish electrical with a male plug when a respective prong is substantially fully inserted into said housing and to prevent an electrical connection to be established when a respective prong is only partially inserted into said housing, said plurality of openings include at least one pair of spaced openings for receiving the spaced prongs of a respective male plug, said plurality of electrical contacts each include a pair of spaced conductive elements for contacting a respective prong, and said spaced conductive elements being a pair of generally U-shaped contact slots for receiving a respective prong of a male plug when fully inserted in said openings said pair of U-shaped contact slot being integrally formed on a terminal member, and a portion of each of said U-shaped contact slots include a bent over portion to increase strength.

* * * * *